US009404287B2

(12) United States Patent
Lepie

(10) Patent No.: US 9,404,287 B2
(45) Date of Patent: Aug. 2, 2016

(54) SYSTEM AND METHOD FOR DETERMINING APPLIANCE DOOR STATUS

(71) Applicant: General Electric Company, Schenectady, NY (US)

(72) Inventor: David H. Lepie, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 726 days.

(21) Appl. No.: 13/735,247

(22) Filed: Jan. 7, 2013

(65) Prior Publication Data

US 2014/0190083 A1 Jul. 10, 2014

(51) Int. Cl.

| | |
|---|---|
| ***E05C 3/06*** | (2006.01) |
| ***E05B 43/00*** | (2006.01) |
| ***E05B 47/00*** | (2006.01) |
| *F24C 15/02* | (2006.01) |
| *D06F 39/14* | (2006.01) |
| *A47L 15/42* | (2006.01) |
| *D06F 37/42* | (2006.01) |

(52) U.S. Cl.

CPC ..... *E05B 43/00* (2013.01); *E05B 43/005* (2013.01); *E05B 47/0012* (2013.01); *A47L 15/4259* (2013.01); *D06F 37/42* (2013.01); *D06F 39/14* (2013.01); *E05B 2047/0068* (2013.01); *E05B 2047/0069* (2013.01); *F24C 15/02* (2013.01); *F24C 15/022* (2013.01)

(58) Field of Classification Search

CPC ..... F24C 15/022; F24C 15/02; F24C 15/028; F24C 15/023; F24C 3/12; E05B 43/00; E05B 43/005; E05B 2047/0068; E05B 2047/0069; E05B 47/0012; D06F 39/14; D06F 37/42; A21B 3/02; A47L 15/4259; Y10T 292/1021

USPC ..... 68/12.26, 196; 70/432, 278.7; 292/DIG. 69, 144, 201; 126/190, 197, 126/192, 194

See application file for complete search history.

(56) References Cited

U.S. PATENT DOCUMENTS

| | | | | | |
|---|---|---|---|---|---|
| 4,533,810 | A * | 8/1985 | Harmon | H05B 6/6417 | 219/721 |
| 5,029,910 | A * | 7/1991 | Genbauffe | F24C 15/022 | 292/110 |
| 5,258,595 | A | 11/1993 | Tanaka | | |
| 5,742,964 | A * | 4/1998 | Choi | D06F 37/42 | 49/31 |
| 5,838,125 | A * | 11/1998 | Choi | D06F 39/14 | 318/285 |
| 5,870,787 | A * | 2/1999 | Choi | D06F 39/14 | 134/113 |
| 6,709,029 | B2 * | 3/2004 | Cole | E05B 17/0029 | 126/197 |
| 7,040,674 | B2 * | 5/2006 | Lomicka | E05B 47/0012 | 292/201 |
| 7,150,480 | B2 * | 12/2006 | Lafrenz | D06F 39/12 | 292/201 |
| 7,414,225 | B2 * | 8/2008 | Yoshidome | F24C 15/022 | 219/392 |

(Continued)

*Primary Examiner* — Christine M Mills

(74) *Attorney, Agent, or Firm* — Dority & Manning, P.A.

(57) ABSTRACT

A system and method of determining the status of an appliance door is provided. The status of the door of the appliance can be determined based an output signal provided by a door switch coupled in series with a latch motor feedback. A change in the output signal of the door switch can be indicative of either the opening of the appliance door or the actuating of the latch motor. The source of the change in an output of the door switch can be determined based on the latch command provided to the latch motor. The appliance can be controlled based on the status of the appliance door.

13 Claims, 5 Drawing Sheets

(56) References Cited

U.S. PATENT DOCUMENTS

| | | | | |
|---|---|---|---|---|
| 7,726,294 | B2 * | 6/2010 | Collene | F24C 15/022 126/192 |
| 7,731,806 | B2 * | 6/2010 | Hapke | A47L 15/4259 134/57 DL |
| 7,735,480 | B2 * | 6/2010 | Larsen | F24C 15/022 126/190 |
| 8,110,779 | B2 | 2/2012 | Kishimoto | |
| 2006/0102166 | A1 * | 5/2006 | Simmons, Jr. | F24C 15/022 126/197 |
| 2007/0296224 | A1 * | 12/2007 | Courter | E05B 17/0029 292/109 |
| 2009/0021373 | A1 * | 1/2009 | Chen | E05B 47/00 340/542 |
| 2011/0083476 | A1 * | 4/2011 | Yang | D06F 37/42 68/12.02 |

* cited by examiner

SYSTEM AND METHOD FOR DETERMINING APPLIANCE DOOR STATUS

FIELD OF THE INVENTION

The present disclosure relates generally to determining the status of an appliance door, and more particularly to an improved system and method of determining the status of an appliance door using an output signal provided from a door switch coupled in series with a latch motor feedback.

BACKGROUND OF THE INVENTION

An appliance can include a door lock mechanism to prevent access to a chamber of the appliance. For instance, an oven can include a door lock mechanism such that the door lock mechanism can be actuated into a locked position to prevent access to a cooking chamber. As another example, a washing machine can include a door lock mechanism such that the door lock mechanism can be actuated into a locked position to prevent access to a washing chamber.

Conventionally, a door lock mechanism can include a door lock latch and a latch motor coupled to the latch to actuate the latch into a locked position. The door lock latch engages a door of the appliance to achieve a locked state. Typical, door lock control systems only consider the status of the latch motor when determining whether the door lock latch has been successfully actuated into the locked position. By omitting consideration of the state of the appliance door, this system can cause a deficiency in the locking method because the door of the appliance can be open during actuation of the latch motor, resulting in the door lock latch reaching a locked position without engaging with the appliance door.

Thus, a need exists for an improved lock control system for an appliance that considers the state of the appliance door. A system and method can be implemented without having to increase the number of inputs and/or hardware in the control system would be particularly useful.

BRIEF DESCRIPTION OF THE INVENTION

Aspects and advantages of the invention will be set forth in part in the following description, or may be apparent from the description, or may be learned through practice of the invention.

One exemplary aspect of the present disclosure is directed to a control system for an appliance. The appliance includes an appliance door. The control system includes a door lock latch movable between a locked position and an unlocked position. The door lock latch is configured to prevent opening of the appliance door when in the locked position. The control system further includes a latch motor configured to drive the door lock latch between the locked position and the unlocked position, a motor feedback providing a signal indicative of the state of the latch motor, and a door switch coupled in series with the motor feedback. The control system further includes a controller configured to receive an output signal from the door switch coupled in series with the motor feedback and to determine a state of the appliance door based at least in part on the output signal from the door switch.

Another exemplary aspect of the present disclosure is directed to a method for determining the state of an appliance door. The method includes receiving, at a controller, an output signal of a door switch associated with the appliance door. The door switch is coupled in series with a latch motor feedback. The latch motor feedback provides a signal indicative of a state of a latch motor capable of actuating a door latch between a lock position and an unlock position. The door latch is configured to prevent opening of the appliance door when in a lock position. The method further includes identifying a latch command provided by the controller to the latch motor; and determining a state of the appliance door based at least in part on the output signal of the door switch and the latch command.

Yet another exemplary aspect of the present disclosure is directed to an appliance. The appliance includes an appliance door and a door lock latch movable between a locked position and an unlocked position. The door lock latch is configured to prevent opening of the appliance door when in the locked position. The appliance further includes a latch motor configured to drive the door lock latch between the locked position and the unlocked position. The appliance further includes a motor feedback providing a signal indicative of the state of the latch motor and a door switch coupled in series with the motor feedback. The appliance includes a controller configured to receive an output signal from the door switch coupled in series with the motor feedback. The controller is capable of determining a state of the appliance door based on the output signal from the door switch.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
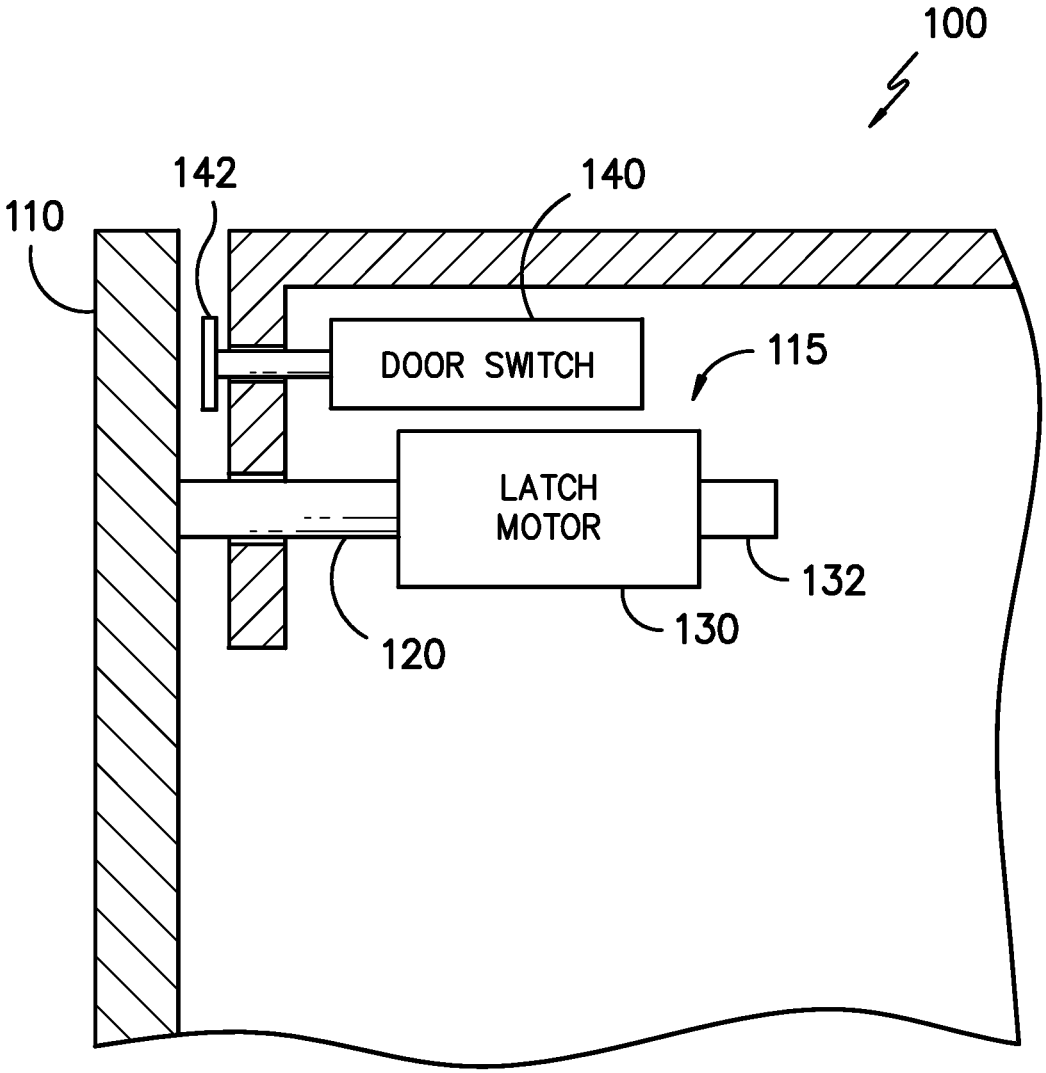
FIG. 1 depicts a simplified diagram of an exemplary appliance door locking system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure relates to a system and method of determining the status of an appliance door. The appliance door can include a locking system that has a door lock latch movable between a locked position and an unlocked position. The door lock latch can be configured to prevent opening of the appliance door when in the locked position. The locking system can further include a latch motor configured to drive the door lock latch between the locked position and the unlocked position. A controller can control the latch motor by sending one or more latch commands to the latch motor via a control input to the latch motor. For instance, the controller can provide a lock command to drive the latch motor to the locked position and an unlock command to drive the latch motor to an unlocked position. A motor feedback can provide a signal indicative of the state of the latch motor.

According to particular aspects of the present disclosure, a door switch is coupled in series with the motor feedback. The controller can receive an output signal from the door switch and determine a state of the appliance door based on the output signal. Because the door switch is coupled in series with the motor feedback, a change in the output of the door switch can be indicative of either a change in the state of the appliance door (e.g. opening of the appliance door) or a change in state of latch motor. The controller can determine the source of the change in the output signal based on the latch command provided to the latch motor. For instance, the door can be determined to be in an open state if the output signal provided from the door switch changes and the latch command provided to the motor has not changed.

Once the status of the door is determined, the appliance can be controlled based on the status of the appliance door. For example, the controller can shut down one or more operations when it is determined that the appliance door is in an open state. As another example, the controller can provide an error signal or alert based on the status of the door.

A control system configured in this manner can provide several advantages. For instance, the control system can independently determine the status of multiple doors of an appliance even if the door lock latch motors of the multiple doors are driven by common control signals. In addition, because the control system is configured by wiring a door switch in series with a control input provided to a door lock latch motor, the complexity and costs of the control system can be reduced. For instance, no further inputs to the controller or major hardware modifications are needed to determine the status of the appliance door.

FIG. 1 illustrates an exemplary appliance door locking system 115 for an appliance 100 according to an exemplary embodiment of the present disclosure. The appliance 100 can be an oven, microwave, dishwasher, refrigerator, washing machine, dryer, or other suitable appliance. The locking system 115 depicted in FIG. 1 is provided for purposes of illustration and discussion. Those of ordinary skill in the art, using the disclosures provided herein, will understand that a wide variety of appliance door locking systems can be used in accordance with aspects of the present disclosure.

As shown in FIG. 1, the appliance 100 includes an appliance door 110 movable between an open state and a closed state. The appliance door 110 can be moved to the open state, for instance, to gain access to an interior chamber of the appliance 100. The appliance 100 further includes a locking system 115 having a door lock latch 120 configured to engage the appliance door 110. The door lock latch 120 is movable between a locked position and an unlocked position. When the door lock latch 120 is in the locked position and is engaging the appliance door 110, the door lock latch 120 prevents opening of the appliance door 110. When the door lock latch 120 is in the unlocked position, the appliance door 110 can be freely opened and closed.

The door lock latch 120 can be actuated between the locked position and the unlocked position by a latch motor 130. As will be discussed in more detail below, the latch motor 130 can receive latch commands from a controller to drive the door lock latch 120 to either the locked position or the unlocked position. The latch motor 130 can be any suitable motor for driving the door lock latch 120, such as a stepper motor. A sensor 132, such as a motor switch or other device, can be used to provide a motor feedback signal indicative of the drive state of the latch motor 130 to a suitable device, such as a controller.

The appliance 100 can further include a door switch 140. The door switch 140 is configured to open or close based on the position of the appliance door 100. For instance, when the appliance door 110 is in a closed state, the appliance door 110 can engage a plunger 142 which causes the door switch 140 to close. When the appliance door 110 is in an open state, the appliance door 110 does not engage the plunger 142. In this case, the door switch 140 is open. According to aspects of the present disclosure, the door switch 140 is coupled in series with a motor feedback to provide an output signal indicative of the state of the appliance door 110.

Figure 2:
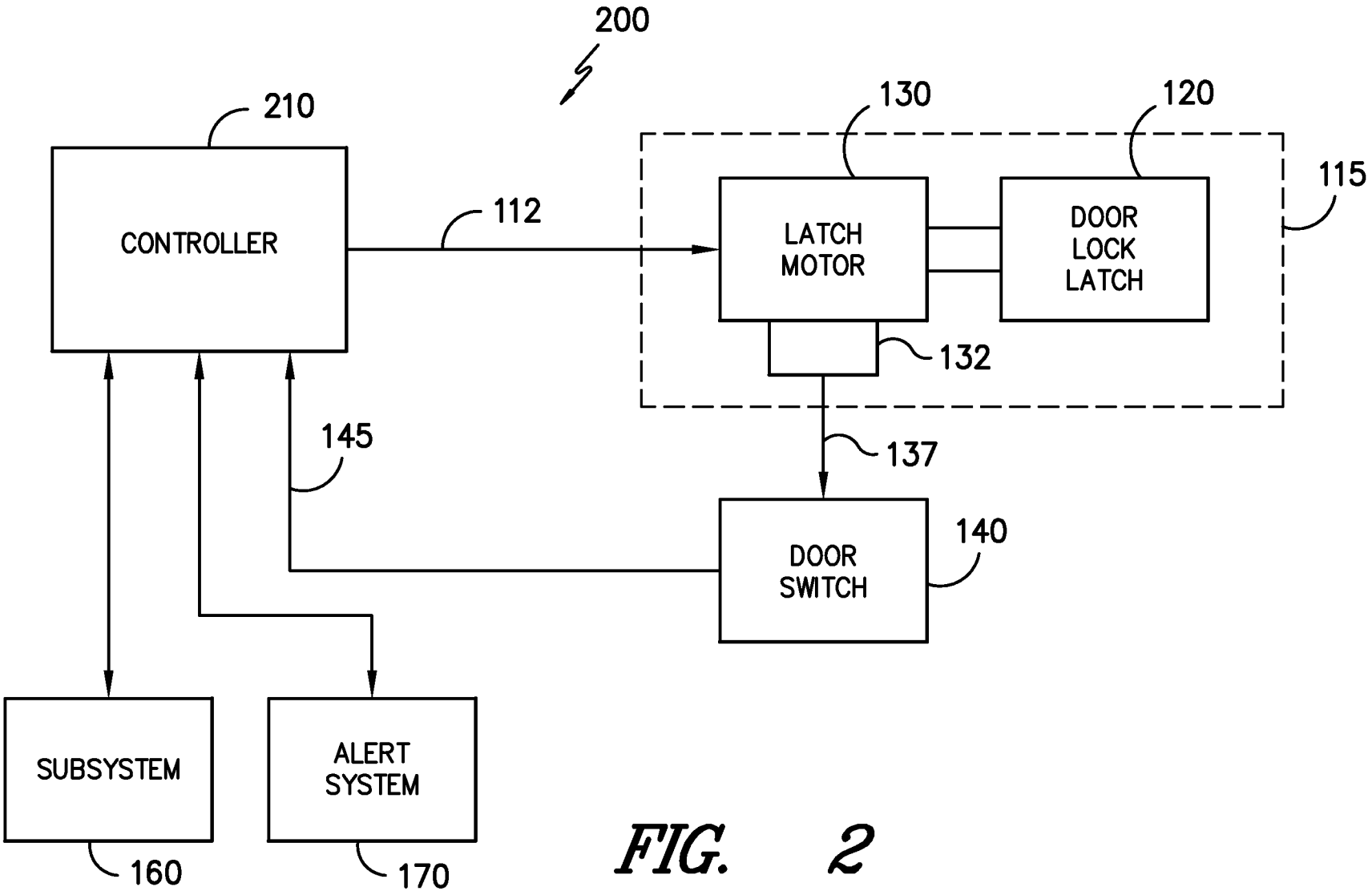
FIG. 2 depicts a schematic diagram of a control system for an appliance according to another exemplary embodiment of the present disclosure.

FIG. 2 depicts a schematic of a control system 200 for an appliance according to an exemplary embodiment of the present disclosure. While FIG. 2 will be discussed with reference to a control system 200 for an appliance having a single appliance door for purposes of illustration and discussion. Those of ordinary skill in the art, using the disclosures provided herein, should understand that the subject matter of the present disclosure is equally applicable to an appliance with multiple appliance doors.

The control system 200 includes a controller 210 used to control various aspect of the appliance, such as a subsystem 160 of the appliance and an alert system 170 of the appliance. The controller 210 can also provide one or more latch commands, such as lock commands and unlock commands, to the locking system 115 to control locking of the appliance door.

The controller 210 can be positioned in any location in the appliance. When the controller 210 is a single controller it can be the only controller in the appliance such that controller 210 controls all operations of the appliance. Alternatively, when the appliance includes a plurality of controllers, controller 210 can be a sub-controller coupled to the overall appliance controller or it could be the overall appliance controller. If controller 210 is a sub-controller, it can be located with the overall appliance controller or be separate from the overall appliance controller.

By way of example, any/all of the "controllers" discussed in this disclosure, may include a memory and one or more processing devices such as microprocessors, CPUs or the like, such as general or special purpose microprocessors operable to execute programming instructions or micro-control code associated with operation of an appliance. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller might also be constructed without using a microprocessor, using a combination of discrete analog and/or digital logic circuitry (such as amplifiers, integrators, comparators, flip-flops, AND gates, and the like) to perform the oven control functionality instead of relying upon software.

Referring still to FIG. 2, the controller 210 can provide latch commands, such as unlock commands or lock commands, to the latch motor 130 via a control input 112. For example, when the controller 210 sends a lock command to the latch motor 130, the latch motor 130 drives the door lock latch 120 to a locked state. When the controller 210 sends an unlock command to the latch motor 130, the latch motor 130 drives the door lock latch 120 to an unlocked state.

The control system 200 can include a sensor, such as a motor switch 132, that provides a motor feedback signal via motor feedback 137 indicative of the drive state of the latch motor 130. In one example, when the latch motor 130 has been driven to a locked state, the motor switch 132 closes and provides a signal indicative of the latch motor 130 being driven to a locked state. In another example, when the latch motor 130 has been driven to an unlocked state, the motor switch 132 opens and provides a signal indicative of the latch motor being driven to an unlocked state.

The door switch 140 is coupled in series with the motor feedback 137. The door switch 140 provides an output signal to the controller 210 via input 145. As discussed above, the door switch 140 can be open or closed depending on the position of the appliance door. For instance, if the appliance door is in a closed state, the door switch 140 can be closed. When the appliance door is in an open state, the door switch 140 can be opened. The controller 210 can determine the state of the appliance door based at least in part on the output signal received from the door switch 140.

For instance, the controller 210 can detect a change in the output signal from the door switch 140 from a first signal state to a second signal state. This change in the output signal can be caused by one of two occurrences. In one case, the appliance door could have changed state (e.g. opened or closed) causing a corresponding change in the output of the door switch 140. Alternatively, because the door switch 140 is coupled in series with the motor feedback 137, the change in state of the output signal can also have been caused by a change in state of the latch motor 130. In particular, a change in state of the latch motor 130 can cause a change in state in the motor switch 132, leading to a change in state in the output signal provided by the door switch 140.

To identify whether the change in state of the output signal is caused by the appliance door or by the latch motor 130, the controller 210 can analyze the latch commands provided to the latch motor 130. In particular, if the latch command provided by the controller 210 has not changed when the output signal from the door switch 140 changes signal state, the controller 210 can determine that the status of the appliance door has changed (e.g. the controller 210 can determine that the appliance door has opened). If the latch command provided by the controller 210 has changed, it can be determined that the change in the output signal results from a change in latch motor 130 position and not from a change in the appliance door state.

In this manner, the controller 210 can determine the state of the appliance door without any additional inputs for the door switch 140. In particular, because the door switch 140 is coupled in series with the motor feedback 137, the controller can receive the output signal from the door switch 140 through an input terminal normally reserved for the motor feedback 137. The controller 210 can identify the source of a change in the output signal from the door switch 140 based on the latch commands provided by the controller 210 to the latch motor 130.

Once the state of the appliance door has been determined, the controller 210 can control the appliance based on the state of the appliance door. For instance, the controller 210 can shut down a subsystem 160 of an appliance (e.g. heating elements of an oven, wash cycle of a dish washer, wash cycle of a washing machine, etc.) in response to determining that the appliance door is in an open state. In addition, the controller 210 can control alert system 170 to provide a suitable alert or other notification that the appliance door is in an open state.

Figure 3:
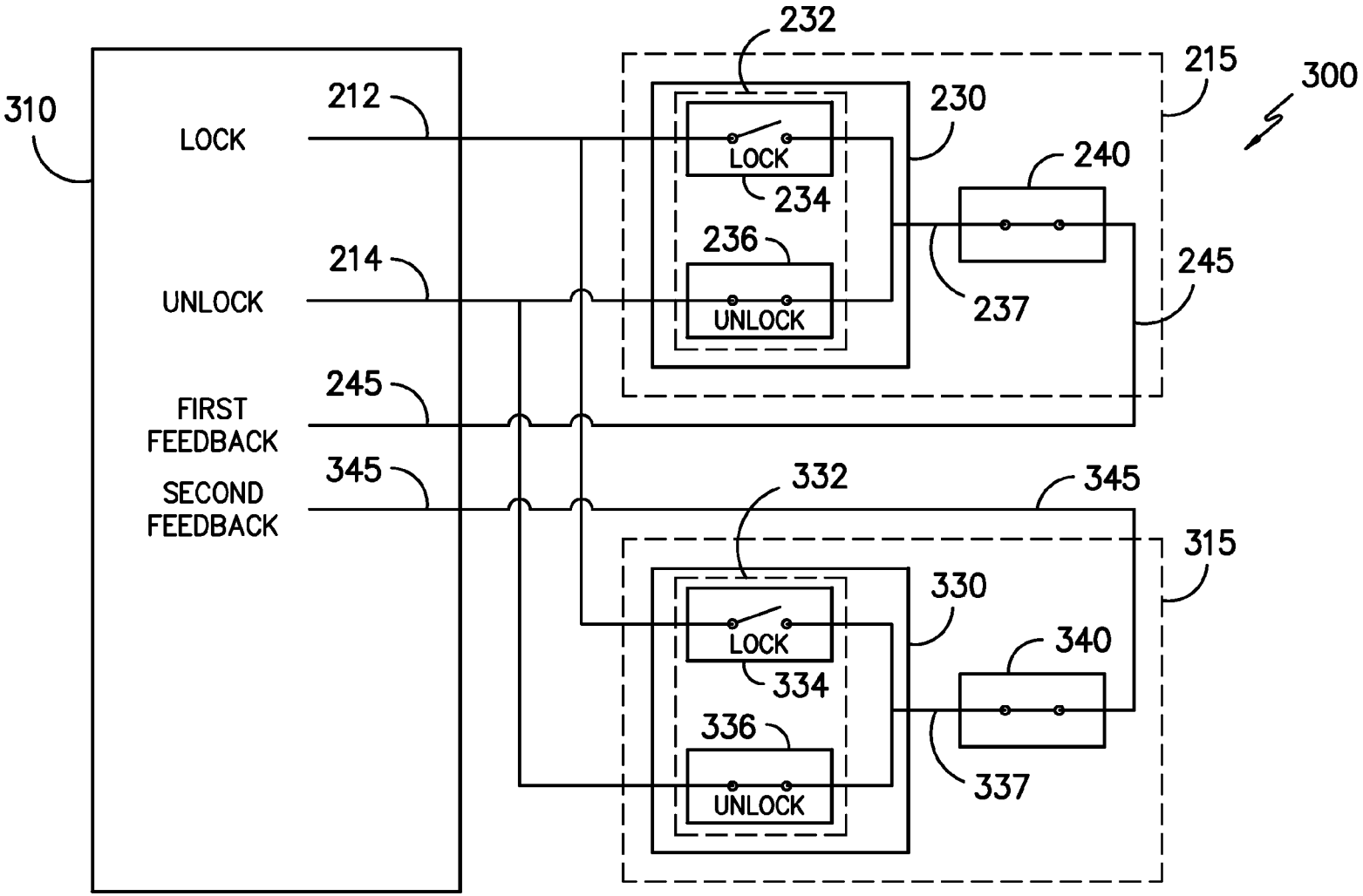
FIG. 3 depicts a schematic diagram of a control system for an appliance according to another exemplary embodiment of the present disclosure.

FIG. 3 depicts a control system 300 for an appliance according to another exemplary embodiment of the present disclosure. The control system 300 will be discussed with reference to an appliance having two appliance doors for purposes of illustration and discussion. Those of ordinary skill in the art, using the disclosures provided herein, should understand that the control system 300 can be used with more or fewer appliance doors without deviating from the scope of the present disclosure.

As shown in FIG. 3, the control system 300 includes a controller 310 configured to control a first locking system 215 and a second locking system 315. Similar to the controller 210 of FIG. 2, the controller 310 can be positioned in any location in the appliance. In addition, when controller 310 is a single controller it can be the only controller in the appliance such that controller 310 controls all operations of the appliance. Alternatively, when the appliance includes a plurality of controllers, controller 310 can be a sub-controller coupled to the overall appliance controller or it could be the overall appliance controller. If controller 310 is a sub-controller, it can be located with the overall appliance controller or be separate from the overall appliance controller.

As shown in FIG. 3, the controller 310 can control a first locking system 215. The first locking system 215 includes a first latch motor 230 configured to actuate a first door lock latch associated with a first appliance door. The controller 310 can provide a control input that provides latch commands to control the latch motor 230. The control input includes a lock input 212 configured to provide a lock command to the latch motor 230 and an unlock input 214 configured to provide an unlock command to the latch motor 230.

The control system 300 includes a motor sensor 232 providing an output signal based on the state of the latch motor 230 to a motor feedback 237. The motor feedback 237 is coupled in series with a door switch 240 associated with the first appliance door. The door switch 240 can provide an output signal to the controller 310 through a suitable input 245. The controller 310 can determine the state of the first appliance door based on the output signal received from the door switch 240.

According to a particular embodiment of the present disclosure, the motor sensor can include a first motor switch 234 and a second motor switch 236. The outputs of the first motor switch 234 and the second motor switch 236 are combined to provide a signal to the motor feedback 237. When the latch motor is in a locked position, the first motor switch 234 closes and the second motor switch 236 opens such that a lock signal is provided to the motor feedback 237. When the latch motor is in an unlock position, the second motor switch closes 236 and the first motor switch 234 opens such that an unlock signal is provided to the motor feedback 237.

Figure 4:
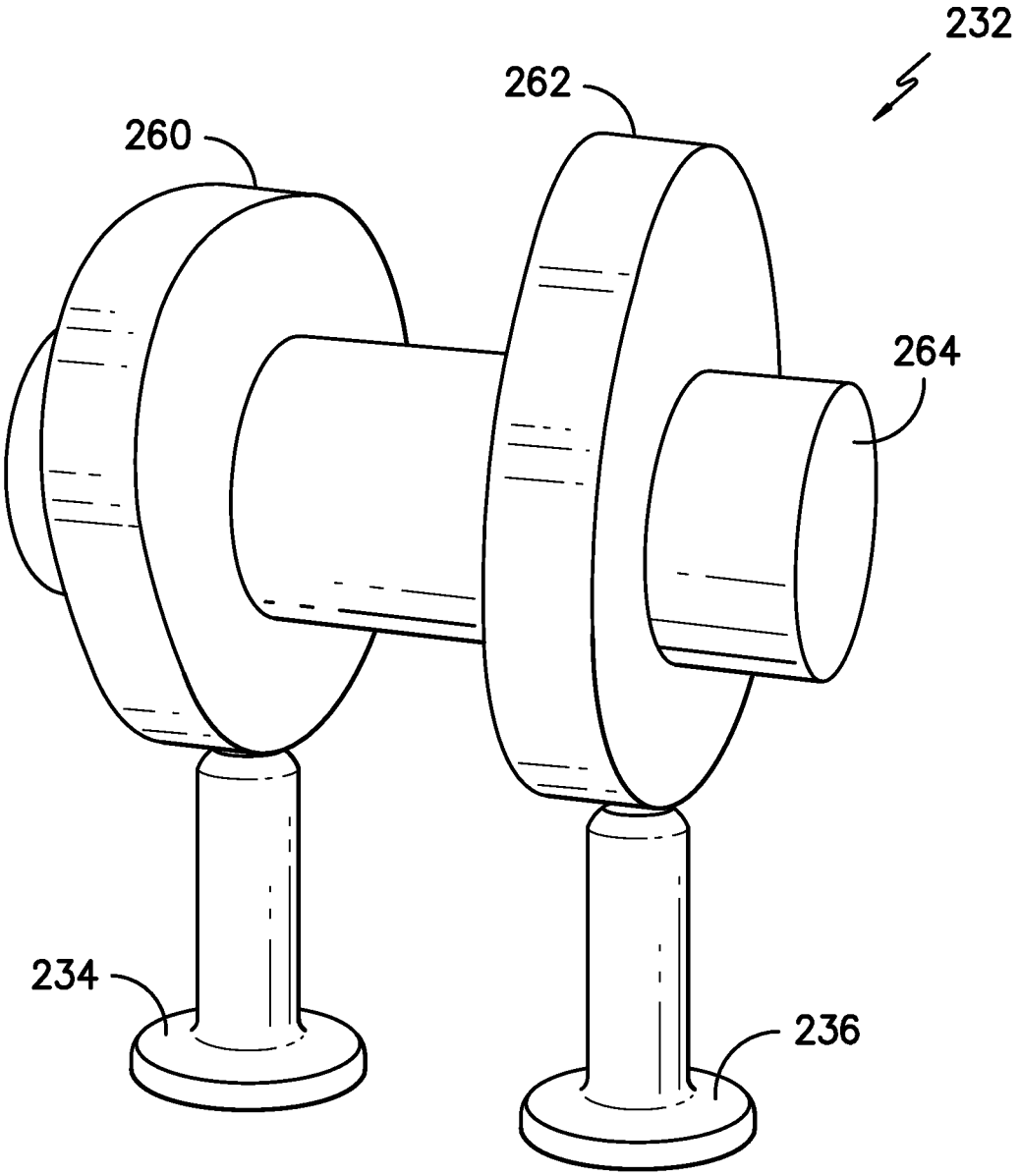
FIG. 4 depicts an exemplary microswitch arrangement for providing a latch motor feedback according to an exemplary embodiment of the present disclosure.

FIG. 4 depicts an exemplary motor sensor 232 implementing a first motor switch 234 and a second motor switch 236 according to an exemplary embodiment of the present disclosure. FIG. 4 depicts one exemplary motor sensor that can be used to provide a signal indicative of latch motor state. Those of ordinary skill in the art, using the disclosures provided herein, will understand that other suitable motor sensors can be used without deviating from the scope of the present disclosure.

As illustrated, motor sensor 232 can include specially shaped cams 260 and 262 coupled to a shaft 264 of the latch motor 230. When the latch motor 230 is driven to a locked state, the cam 260 engages the first motor switch 234 causing the first motor switch 234 to close. At the same time, cam 262 disengages second motor switch 236 causes the second motor switch 236 to open. When the latch motor 230 is driven to an unlocked state, the cam 260 disengages the first motor switch 234 causing the first motor switch to open. At the same time, cam 262 engages the second motor switch 236 causing the second motor switch to close.

Referring back to FIG. 3, the controller 310 can determine the state of the first appliance door based on the output signal provided by the door switch 240. For instance, if the output signal provided by the door switch 240 is in a signal state indicative of a closed door switch 240 and a closed first motor switch 234, the controller 310 can determine that the first appliance door is in a closed and locked state. If the output signal provided by the door switch 240 is in a signal state indicative of a closed door switch 240 and a closed second motor switch 236, the controller 310 can determine that the first appliance door is in a closed and unlocked state.

The output signal provided by the door switch 240 can also be in a signal state indicative of an open circuit. An output signal provided by the door switch 240 that is in a signal state indicative of an open circuit can be caused by an either opening of the first appliance door or by the latch motor 130 being in a transition position between an unlocked state or a locked state. In particular, opening of the first appliance door will lead to opening of the door switch 240 causing an output signal indicative of an open circuit. In addition, as the latch motor 130 translates between locked and unlocked positions, both motor switches 234 and 236 can be in an open state, causing an output signal to be indicative of an open circuit.

To identify whether the output signal indicative of an open circuit results from the opening of an appliance door or from the transitioning of the latch motor 230, the controller 310 can analyze the latch commands provided to the latch motor 230. In particular, if the latch commands provided by the controller 310 to the latch motor 230 have not changed when the output signal from the door switch 240 changes to a signal indicative of an open circuit, the controller 210 can determine that the status of the appliance door has changed (e.g. the controller 310 can determine that the appliance door has opened). If the latch commands provided by the controller 310 have changed, it can be determined that the change in the output signal results from a change in latch motor 230 position and not from a change in the appliance door state.

In addition, the controller 310 can determine whether an output signal indicative of an open circuit results from opening of the appliance door based on a lapse of a time interval after the change in the output signal from the door switch 240 to a signal indicative of an open circuit. For instance, if the controller 310 detects a change in the output signal from the door switch 240 to a signal indicative of an open circuit, the controller 310 can initiate a timer. The timer can be set for a time interval. The time interval can be equal to or greater than the time it takes for the latch motor 230 to transition between locked and unlocked positions. If the output signal remains in a signal state indicative of an open circuit after the lapse of the time interval, the controller 310 can determine that the output signal from the door switch 240 is indicative of the first appliance door being in an open state.

As shown in FIG. 3, the controller 310 can also control a second locking system 315 associated with a second appliance door. Similar to the first locking system, the second locking system 315 can include a second latch motor 330 configured to actuate a second door lock latch associated with a second appliance door. The controller 310 can provide a control input that provides latch commands to control the latch motor 330. The control input can be a common control input for the first latch motor 230 and the second latch motor 330 and can include the lock input 312 configured to provide a lock command to the second latch motor 330 and an unlock input 314 configured to provide an unlock command to the second latch motor 330. The first latch motor 230 and the second latch motor 330 can be controlled independently or simultaneously.

The control system 300 includes a motor sensor 332 providing an output signal based on the state of the second latch motor 330 to a motor feedback 337. The motor feedback 337 is coupled in series with a door switch 340 associated with the second appliance door. The door switch 340 can provide an output signal to the controller 310 through a suitable input 345. The controller 310 can determine the state of the second appliance door based on the output signal received from the door switch 340 according to any of the techniques discussed herein.

Figure 5:
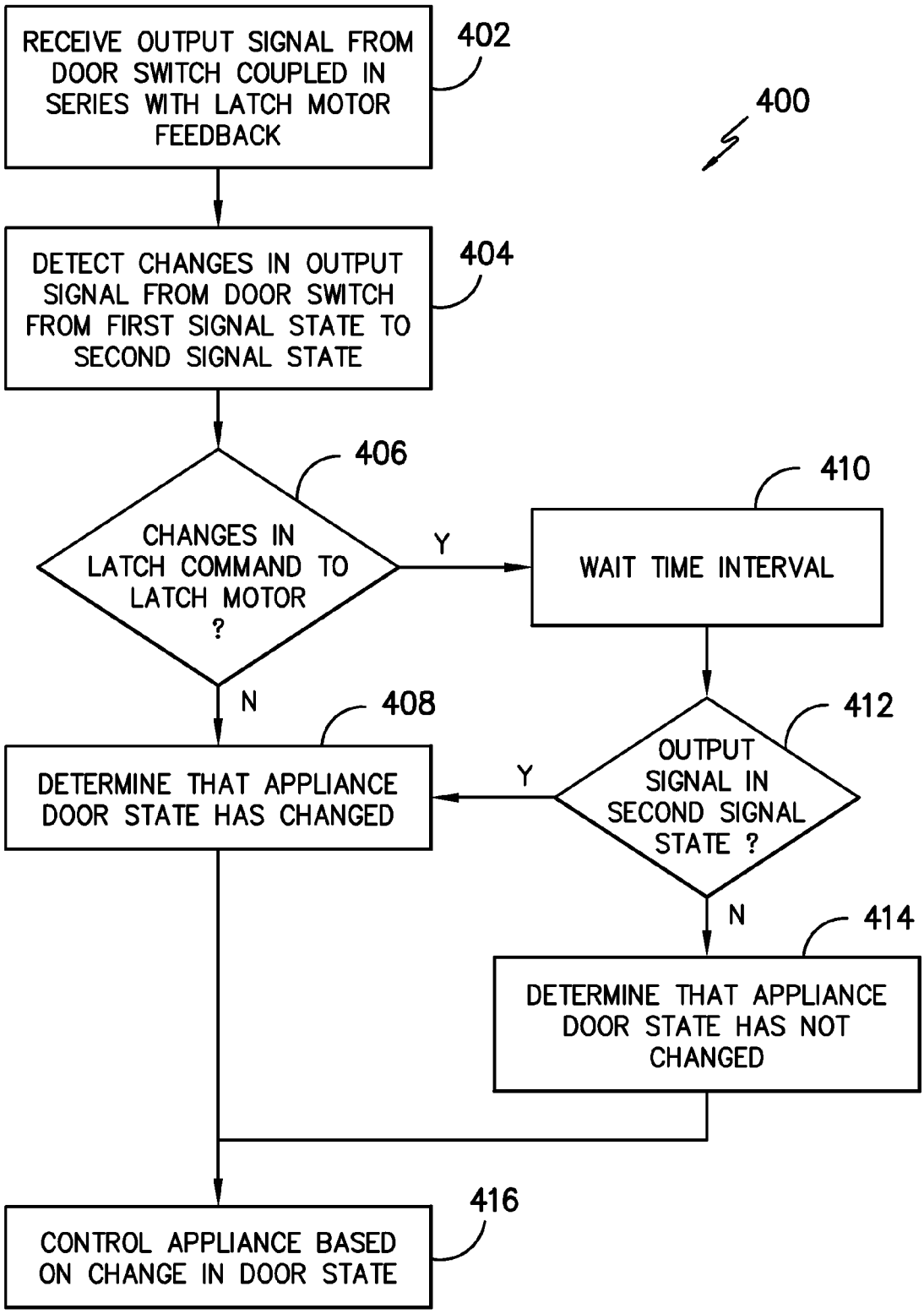
FIG. 5 depicts a flow chart of a method according to an exemplary embodiment of the present disclosure.

FIG. 5 depicts a flow diagram of one exemplary method (400) for determining the state of an appliance door according to an exemplary embodiment of the present disclosure. At (402), the method includes receiving an output signal from a door switch coupled in series with a latch motor feedback. The latch motor feedback provides a signal indicative of a state of a latch motor used to actuate a door lock latch between a locked position and an unlocked position.

At (404), the method detects a change in the output signal from the door switch from a first signal state to a second signal state. The first signal state can be indicative of a closed appliance door. The second signal state can be indicative of an open circuit. Because the door switch is coupled in series with the latch motor feedback, the second signal state can be indicative of either a change in the state of the appliance door (e.g. opening of the appliance door) or a change in the state of the latch motor.

To determine the source of the change in the output signal, the method at (406) determines whether there has been a change in the latch command(s) provided to the latch motor. If not, it can be determined that the state of the appliance door has changed (408). If the latch commands have changed, the method can include waiting for the lapse a time interval (410) to ensure that the latch motor has had time to fully transition to a new state (e.g. a locked state or an unlocked state). The method can then determine if the output signal is still in the second state (412). If so, it can be determined that the appliance door has changed state (408). If not, the change in the output signal must have resulted from a change in the state of the latch motor and it can be determined that the appliance door has not changed state (414). Once the state of the door has been determined, the method can include controlling the appliance based on the state of the appliance door (416).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A control system for an appliance, the control system comprising:

a door lock latch movable between a locked position and an unlocked position, the door lock latch configured to prevent opening of an appliance door when in the locked position;

a latch motor configured to drive the door lock latch between the locked position and the unlocked position;

a motor feedback associated with at least one motor switch providing a signal indicative of a state of the latch motor;

a door switch coupled in series with the motor feedback; and a controller which detects a change in an output signal from the door switch coupled in series with the motor feedback, determines whether the change in the output signal was caused by the motor feedback associated with the at least one motor switch or the door switch coupled in series with the motor feedback based at least in part on at least one latch command associated with the latch motor, and determines a state of the appliance door based at least in part on whether the change in the output signal was caused by the motor feedback or the door switch.

2. The control system of claim 1, wherein the controller is configured to determine whether the appliance door is an open state or a closed state.

3. The control system of claim 1, wherein the controller provides a control input to the latch motor, the control input providing the at least one latch command driving the motor to a lock state or to an unlock state.

4. The control system of claim 3, wherein the control input comprises a lock input for providing a lock command to the latch motor and an unlock input for providing an unlock command to the latch motor.

5. The control system of claim 1, wherein the controller is configured to determine the state of the appliance door based at least in part on a change in the latch command and the lapse of a time interval.

6. The control system of claim 1, wherein the at least one motor switch comprises a first motor switch and a second motor switch associated with the latch motor, the first motor switch configured to close when the latch motor is in a lock state and the second motor switch configured to close when the latch motor is in an unlock state.

7. The control system of claim 6, wherein the first motor switch and the second motor switch are configured to be closed by a rotating cam of the latch motor.

8. The control system of claim 1, wherein the controller is configured to control the appliance based on the state of the appliance door.

9. The control system of claim 1, wherein the appliance comprises a second appliance door, the control system comprising:

a second door lock latch movable between a locked position and an unlocked position, the second door lock latch configured to prevent opening of the second appliance door when in the locked position;

a second latch motor configured to drive the second door lock latch between the locked position and the unlocked position;

a second motor feedback providing a signal indicative of a drive state of the second latch motor; and a second door switch coupled in series the second motor feedback, the second door switch providing an output signal to the controller.

10. The control system of claim 9, wherein the controller is configured to provide a common control input to the latch motor and the second latch motor.

11. The control system of claim 9, wherein the controller is configured to determine a state of the second appliance door based on the output signal from the second door switch and a latch command provided to the second latch motor via the common control input.

12. An appliance, comprising:

an appliance door;

a door lock latch movable between a locked position and an unlocked position, the door lock latch configured to prevent opening of the appliance door when in the locked position;

a latch motor configured to drive the door lock latch between the locked position and the unlocked position;

a motor feedback associated with a sensor device providing a signal indicative of a state of the latch motor;

a door switch coupled in series with the motor feedback; and a controller which receives an output signal from the door switch coupled in series with the motor feedback, determines whether the output signal is associated with the motor feedback associated with the sensor device or the door switch based at least in part on at least one latch motor command associated with the latch motor, and determines a state of the appliance door based at least in part on whether the output signal is associated with the motor feedback or the door switch.

13. The appliance of claim 12, wherein the controller provides a control input to the latch motor, the control input providing the at least one latch motor command driving the motor to a lock state or to an unlock state, the controller configured to determine the state of the appliance door based at least in part on the output signal from the door switch and the at least one latch motor command.

* * * * *